US006368236B1

(12) United States Patent
Sullivan et al.

(10) Patent No.: US 6,368,236 B1
(45) **Date of Patent: *Apr. 9, 2002**

(54) GOLF BALL AND METHOD OF MANUFACTURE

(75) Inventors: Michael J. Sullivan, Chicopee; Mark Binette, Ludlow, both of MA (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/707,316

(22) Filed: Nov. 7, 2000

Related U.S. Application Data

(63) Continuation of application No. 09/236,812, filed on Jan. 25, 1999, now Pat. No. 6,142,886.

(51) Int. Cl.[7] ..... A63B 37/04; A63B 37/06; A63B 37/12; A63B 37/14

(52) U.S. Cl. ..... 473/377; 473/378; 473/376; 473/371; 473/374

(58) Field of Search ..... 473/351, 371, 473/373, 374, 376, 377, 378

(56) References Cited

U.S. PATENT DOCUMENTS

| | | | | |
|---|---|---|---|---|
| 4,848,770 A | | 7/1989 | Shama | |
| 5,334,673 A | * | 8/1994 | Wu | 473/378 |
| 5,439,227 A | | 8/1995 | Egashira et al. | |
| 5,779,562 A | * | 7/1998 | Melvin et al. | 473/373 |
| 5,833,553 A | * | 11/1998 | Sullivan et al. | 473/374 |
| 5,971,870 A | * | 10/1999 | Sullivan et al. | 473/373 |

* cited by examiner

*Primary Examiner*—Jeanette Chapman
*Assistant Examiner*—Alvin A. Hunter

(57) ABSTRACT

This invention relates to golf balls having a relatively soft cover and soft core which, in combination, provide golf balls with PGA compression ratings under 70 and a cover Shore D hardness of about 57 or less having good play "feel" and a soft sound.

27 Claims, No Drawings

GOLF BALL AND METHOD OF MANUFACTURE

This application is a Continuation of application Ser. No. 09/236,812, filed Jan. 25, 1999, now U.S. Pat. No. 6,142, 886.

FIELD OF THE INVENTION

The present invention relates generally to golf balls and is concerned more particularly with those having a two-piece construction.

BACKGROUND OF THE INVENTION

The play "feel" and spin rate of a golf ball are particularly important aspects to consider when selecting a golf ball for play. Play "feel" encompasses such subjective and objective attributes as the nature and quality of the club-to-ball contact as transmitted through the club grip to the player and the sound made when the club face impacts the ball. The rate of spin a ball may achieve is of great importance, particularly to the skilled golfer. A golf bail with the capacity to attain a high rate of spin allows the skilled golfer, such as the PGA (Professional Golf Association) professional or low handicap player, the opportunity to maximize control over the golf ball. This is particularly beneficial when hitting a shot on an approach to the green. Thus, golfers of high proficiency generally prefer to play with a ball exhibiting high spin rate capabilities and most typically will select a relatively soft covered ball with which to play.

To attain the objectives of good play feel and high spin rate many skilled golfers traditionally select balata covered balls. The balata covering, whether in the form of a natural or synthetic trans-polyisoprene, creates a ball cover which is relatively soft and typically provides both a good play feel and high spin rate potential. However, balata covered balls suffer from the drawback of low durability. Even in normal use, the softness of the balata covering can easily lead to surface cuts in the covering making the ball unsuitable for further play.

The problems associated with balata covered balls have spurred manufacturers to find other covering materials which are more durable. A particular class of materials used in golf ball covers which has met with success are the ionomer resins. In particular copolymer and terpolymer forms of ionomer resins have been widely used and accepted in golf ball cover materials.

SUMMARY OF THE INVENTION

One characteristic of the invention is to provide a golf ball having a soft cover and a soft core.

Another characteristic of the invention is to provide a golf ball having a high potential spin rate which permits the skilled golfer to have a high degree of control over the ball.

Yet another characteristic of the invention is to provide a golf ball having enhanced play feel without sacrificing the distance the ball travels per shot.

An advantage of the invention is to provide a golf ball which produces a pleasing soft sound on impact with a golf club.

Another advantage of the invention is to provide a golf ball with a cover that is as soft, or softer than a balata covered ball, yet is more cut resistant than a balata covered ball.

A final object of the invention is a process for making a golf ball of the type described herein, Other objects, features, advantages and characteristics of the invention will be in part obvious and in part pointed out more in detail hereinafter.

These and other related aspects of the invention are achieved by providing a highly durable golf ball which is relatively "soft". Such a ball comprises a soft core with a cover which in one embodiment has a Shore D hardness of about 57 or less, yielding a ball with a PGA compression of about 62 or less, and in another embodiment, the cover has a Shore D hardness of about 54 or less yielding a ball with a PGA compression of about 67 or less.

In yet another embodiment, the golf ball of the invention has a cover with a Shore D hardness of 57 or less and exhibits a mechanical impedance with a primary minimum value in the range of 2400 Hz or less when maintained at about 21° C., 1 atmosphere pressure and 50% relative humidity for at least 15 hours.

DETAILED DESCRIPTION OF THE INVENTION

The present invention relates to a golf ball having a two-piece construction comprising a core and a cover surrounding the core. The invention also relates to a method of making such a golf ball. The golf ball of the invention exhibits properties which make it a relatively "soft" ball, wherein in one embodiment the cover has a Shore D hardness measuring about 57 or less and the ball has a PGA compression of about 62 or less. In this embodiment, the Shore D hardness of the cover preferably ranges from 20–57, with a range of 40–57 being more preferred and a range of 45–54 most preferred. Optionally, the Shore D hardness of the cover may range from 20–54 and 20–50. The PGA compression of the ball in this embodiment preferable ranges form 10–62, with a range of 20–62 being more preferred and a range of 30–60 most preferred.

In another embodiment, the Shore D hardness of the cover measures about 54 or less and the ball has a PGA compression of about 67 or less. In this embodiment, the Shore D hardness of the cover preferably ranges form 20–54 and more preferably ranges from 40–54. The PGA compression of the ball in this embodiment preferably ranges from 10–67, with a range of 20–67 being more preferred and a range of 30–62 being most preferred.

In yet another embodiment of the ball, the cover has a Shore D hardness of 57 or less and the ball exhibits a low natural resonant frequency with a primary minimum value for the ball's mechanical impedance being in the range of 2400 Hz or less when the ball is maintained at about 21° C. in 1 atmosphere pressure and 50% relative humidity for at least 15 hours immediately prior to mechanical impedance testing. The cover of the ball preferably has a Shore D hardness in the range of 20–57 and the primary minimum value of mechanical impedance is preferably in the range of 1800–2400 Hz and more preferably 2000–2400 Hz.

In all of the embodiments of the invention, the ball has a coefficient of restitution (COR) in the range of 0.730 or more, with a COR of 0.760 or more being preferred and a COR of 0.770 or more being most preferred.

The core of the ball is molded using largely conventional techniques and the composition of the core may be based on such conventional materials as polybutadiene, natural rubber, metallocene catalyzed polyolefins such as EXACT (commercially available from Exxon Chemical Co., Saddlebrook, N.J.) and ENGAGE (commercially available from Dow Chemical Co., Midland, Mich.), polyurethanes, other thermoplastic or thermoset elastomers, and mixtures of one or more of the above materials with each other and/or with other elastomers. The core may preferably be formed from a uniform composition or may optionally have dual or multiple layers. Also, the core may be foamed to create a cellular structure or the core may be left unfoamed.

Polybutadiene has been found to be a particularly useful core material because it imparts to the golf balls a relatively high coefficient of restitution. A broad range for the molecular weight of preferred base elastomers is from about 50,000 to about 500,000. It is preferred that the base elastomer have a relatively high molecular weight. A more preferred range for the molecular weight of the base elastomer is from about 100,000 to about 500,000. As a base elastomer for the core composition, cis-1-4-polybutadiene is preferably employed. Optionally, a blend of cis-1-4-polybutadiene with other elastomers may also be utilized as the base elastomer. Most preferably, cis-1-4-polybutediene having a weight-average molecular weight of from about 100,000 to about 500,000 is employed. Along this line, it has been found that the polybutadienes manufactured and sold by Bayer Corp., Germany, under the trademark TAKTENE 220 and by Muehistein, Norwalk, Conn., under the trademark CARIFLEX 1220 are particularly preferred. Furthermore, the core may be comprised of a crosslinked natural rubber, EPDM, metallocene catalyzed polyolefin, or other crosslinkable elastomer.

When polybutadiene is used for golf ball cores, it commonly is crosslinked with an unsaturated carboxylic acid crosslinking agent. The unsaturated carboxylic acid component of the core composition typically is the reaction product of the selected carboxylic acid or acids and an oxide or carbonate of a metal such as zinc, magnesium, barium, calcium, lithium, sodium, potassium, cadmium, lead, tin, and the like. Preferably, the oxides of polyvalent metals such as zinc, magnesium and cadmium are used, and most preferably, the oxide is zinc oxide.

Examples of the unsaturated carboxylic acids which find utility in the core compositions include acrylic acid, methacrylic acid, itaconic acid, crotonic acid, sorbic acid, and the like, and mixtures thereof. Preferably, the acid component is either acrylic or methacrylic acid. Usually the carboxylic acid cross-linking agent is included in the core composition in an amount from about 5 to about 40, and preferably from about 15 to about 30 parts by weight of the core composition. Zinc diacrylate (ZDA) is a preferred form of the carboxylic acid cross-linking agent. The unsaturated carboxylic acids and metal salts thereof are generally soluble in the elastomeric base, or are readily dispersible therein.

Polybutadiene can be cured using a free radical initiator such as a peroxide. The free radical initiator included in the core composition is any known polymerization initiator (a co-crosslinking agent) which decomposes during the cure cycle. The term "free radical initiator" as used herein refers to a chemical which, when added to a mixture of the elastomeric blend and a metal salt of an unsaturated, carboxylic acid, promotes crosslinking of the elastomers by the metal salt of the unsaturated carboxylic acid. The amount of the selected initiator present is dictated only by the requirements of catalytic activity as a polymerization initiator. Suitable initiators include peroxides, persulfates, azo compounds and hydrazides. Peroxides which are readily commercially available are conveniently used in the present invention, generally in amounts of from about 0.1 to about 10.0 and preferably in amounts of from about 0.3 to about 3.0 parts by weight per each 100 parts of elastomer.

Examples of suitable peroxides for use of the present invention include dicumyl peroxide, n-butyl 4,4'-bis (butylperoxy) valerate, 1,1-bis(t-butylperoxy)-3,3,5-trimethyl cyclohexane, di-t-butyl peroxide and 2,5-di-(t-butylperoxy)-2,5 dimethyl hexane and the like, as well as mixtures thereof. It will be understood that the total amount of initiators used will vary depending on the specific end product desired and the particular initiators employed. Those of ordinary skill in the art will recognize that a butadiene rubber which is highly crosslinked will tend to be harder than a less crosslinked rubber, Therefore, the consistency of the core can be controlled in part by judicious use of the initiator.

Examples of such commercially available peroxides are LUPERCO 230 or 231 XL commercially available from Atochem, Lucidol Division, Buffalo, N.Y., and TRIGONOX 17/40 or 29/40 commercially available from Akzo Chemicals, Chicago, Ill.

Those skilled in the art will recognize that the polybutadiene of the core can also be cured using sulfur curing techniques and materials which are known in the art.

The core compositions of the present invention may additionally contain other suitable and compatible modifying ingredients including, but not limited to, metal oxides, fatty acids, and diisocyanates and polypropylene powder resin. For example, PAPI 94, a polymeric diisocyanate, commercially available from Dow Chemical Co., Midland, Mich., is an optional component in the rubber compositions. It can range from about 0 to 5 phr (parts per hundred weight ratio) of the rubber component, and acts as a moisture scavenger. In addition, it has been found that the addition of a polypropylene powder resin results in a core which is hard (i.e. exhibits high PGA compression) and thus allows for a reduction in the amount of crosslinking co-agent utilized to soften the core to a normal or below normal compression.

Furthermore, because olefins, such as polypropylene powder resin, can be added to a core composition without an increase in weight of the molded core upon curing the addition of the polypropylene powder allows for the addition of higher specific gravity fillers, such as mineral fillers. Since the crosslinking agents utilized in the polybutadiene core compositions are relatively expensive and the higher specific gravity fillers are inexpensive, the addition of the polypropylene powder resin substantially lowers the cost of the golf ball cores while maintaining, or lowering, weight and compression.

The polypropylene powder suitable for use in the present invention has a specific gravity of about 0.90 g/cm$^3$, a melt flow rate from about 4 to about 12 and a particle size distribution of greater than 99% through a 20 mesh screen. Examples of such polypropylene powder resins include those commercially available from the Amoco Chemical Co., Chicago, Ill., under the designations 6400 P, 7000 P and 7200 P. Generally, from 0 to about 25 parts by weight polypropylene powder per each 100 parts of elastomer may be included in the core composition of the present invention.

Various activators may also be included in the compositions of the present invention. For example, zinc oxide and/or magnesium oxide are activators for the polybutadiene. The activator can range from about 2 to about 30 phr of the rubber component.

Reinforcement agents may also be added to the core compositions of the present invention. Since the specific gravity of polypropylene powder is very low and when compounded the polypropylene powder produces a lighter molded core, relatively large amounts of higher specific gravity fillers may need to be added to meet specific core weight limitations. As indicated above, additional benefits may be obtained by the incorporation of relatively large amounts of an inexpensive high specific gravity mineral filler, such as ground calcium carbonate or ground limestone (a mixture of carbonates of calcium and magnesium). Such fillers for use in the core composition should be finely divided. For example, the calcium carbonate should be generally less than about 30 mesh and preferably less than about 100 mesh U.S. standard size. The amount of additional filler included in the core composition is primarily dictated by weight restrictions and preferably is included in amounts of from about 10 to about 100 phr of the rubber component.

The preferred fillers are inexpensive, have a high relative mass, serve to lower the cost of the ball and to increase the weight of the ball so as to approach the USGA (United States Golf Association) weight limit of 1.620 ounces. However, if thicker cover compositions are to be applied to the core to produce larger than normal (i.e. greater than 1.680 inches in diameter) balls, use of such fillers and modifying agents may need to be limited in order to meet the 1.620 ounce maximum weight limit, Alternately, ground flash filler may be incorporated and is preferably 20 mesh ground up stock from the excess flash from compression molding of covers. Use of ground flash lowers the cost of core manufacture but may increase the hardness of the ball. Other suitable fillers for the core composition include particulate polypropylene, pecan shell flour, barium sulfate, and zinc oxide. These materials are particularly useful in helping to adjust the weight of the finished golf ball so as to approach the weight limit of 1.620 ounces.

Fatty acids or metallic salts of fatty acids may also be included in the compositions, functioning to improve moldability and processing. Generally, free fatty acids having from abut 10 to about 40 carbon atoms, and preferably having from about 15 to about 10 carbon atoms, are used. Examples of suitable fatty acids include stearic acid and linoleic acid, as well as mixtures thereof. Examples of suitable metallic salts of fatty acids include zinc stearate. When included in the core composition, the metallic salts of fatty acids are present in amounts of from about 1 to about 25, preferably in amounts from about 2 to about 20 phr of the base rubber (elastomer). It is preferred that the core compositions include stearic acid as the fatty acid adjunct in an amount of from about 2 to about 5 phr of the rubber component.

Diisocyanates may also be optionally included in the core compositions. When utilized, the diisocyanates are included in amounts of from about 0.2 to about 5.0 phr of the rubber component. Examples of suitable diisocyanates include 4,4'-diphenylmethane diisocyanate and other polyfunctional isocyanates known to the art.

Furthermore, the dialkyl tin difatty acids set forth in U.S. Pat. No. 4,844,471, the dispensing agents disclosed in U.S. Pat. No. 4,838,556, and the dithiocarbamates set forth in U.S. Pat. No. 4,852,884 may also be incorporated into the polybutadiene compositions of the present invention. The specific types and amounts of such additives are set forth in the above identified patents, which are incorporated herein by reference.

The core compositions of the present invention which contain polybutadiene are generally comprised of 100 parts by weight of the base elastomer selected from polybutadiene and mixtures of polybutadiene with other elastomers, 15 to 35 phr of at least one metallic salt of an unsaturated carboxylic acid, and 0.0 to 10 phr of a free radical initiator both based on the base elastomer, In producing solid golf ball cores utilizing the present compositions, the ingredients may be intimately mixed using, for example, two roll mills or an internal mixer until the composition is uniform, usually over a period of from about 5 to about 20 minutes. The sequence of addition of components is not critical. A preferred blending sequence is as follows.

The elastomer, polypropylene powder resin (if desired), fillers, zinc salt, metal oxide, fatty acid, and the metallic dithiocarbamate (if desired), surfactant (if desired), and tin difatty acid (if desired), are blended for about 7 minutes in an internal mixer such as a BANBURY (Farrel Corp.) mixer. As a result of shear during mixing, the temperature rises to about 200° F. The initiator and diisocyanate are then added and the mixing continued until the temperature reaches about 220° F. whereupon the batch is discharged onto a two roll mill, mixed for about one minute and sheeted out.

The sheet is rolled into a "pig" and then placed in a Barwell preformer and slugs are produced. The slugs are then subjected to compression molding at about 320° F. for about 14 minutes. After molding, the molded cores are cooled, the cooling effected at room temperature for about 4 hours or in cold water for about one hour. The molded cores can be subjected to a centerless grinding operation whereby a thin layer of the molded core is removed to produce a round core having a diameter of 1.2 to 1.6 inches. Alternatively, the cores are used in the as-molded state with no grinding needed to achieve roundness.

The mixing is desirably conducted in such a manner that the composition does not reach incipient polymerization temperatures during the blending of the various components.

Usually the curable component of the composition will be cured by heating the composition at elevated temperatures on the order of from about 275° F. to about 350° F., preferably and usually from about 290° F. to about 325° F., with molding of the composition effected simultaneously with the curing thereof. The composition can be formed into a core structure by any one of a variety of molding techniques, e.g. injection, compression, or transfer molding. The time required for heating to promote curing will normally be short, generally from about 10 to about 20 minutes, depending upon the particular curing agent used. Those of ordinary skill in the art relating to free radical curing agents for polymers are conversant with adjustments of cure times and temperatures required to effect optimum results with any specific free radical agent.

After molding, the core is removed from the mold and the surface thereof optionally is treated to facilitate adhesion thereof to the covering materials. Surface treatment can be effected by any of the several techniques known in the art, such as corona discharge, ozone treatment, sand blasting, and the like. Preferably, surface treatment is effected by grinding with an abrasive wheel.

Several examples of cores were prepared according to the following process. The core ingredients were intimately mixed in a two roll mill until the compositions were uniform, usually over a period of from about 5 to about 20 minutes. The sequence of addition of the components was not found to be critical. The batch is removed from the mill as a sheet. The sheet was cut into strips and fed into an extruder preformer and slugs produced. The slugs were then subjected to compression molding at about 320° F. for about 14 minutes. After molding, the cores were cooled under ambient conditions for about 4 hours. The molded cores were then subjected to a centerless grinding operation whereby a thin layer of the molded core was removed to produce a round core having a diameter of 1.545 to 1.57 inches. Upon completion, the cores were measured for size and in some instances weighed and tested to determine compression and COR.

Several examples of cores were prepared using the formulations set forth in Table I below.

TABLE 1

| | Core Types | | | | | | | |
|---|---|---|---|---|---|---|---|---|
| Ingredients | A | B | C | D | E | F | G | H |
| CARIFLEX 1220 | 100 | 100 | 73 | 73 | 73 | 73 | 75 | 100 |
| TAKTENE 220 | 0 | 0 | 27 | 27 | 27 | 27 | 25 | 0 |
| zinc oxide | 20.5 | 17.8 | 22.3 | 23.8 | 24.8 | 25.8 | 9 | 25 |
| ZOA | 27 | 31.6 | 26 | 24 | 22 | 20 | 25 | 20 |
| regrind | 9 | 9 | 10 | 10 | 10 | 10 | 15 | 20 |
| zinc stearate | 20 | 20 | 20 | 20 | 20 | 20 | 20 | 15 |
| TRIGONOX 17/40 | 0.6 | 0.6 | — | 0 | 0 | 0 | 0.6 | 0 |
| 231 XL | 0 | 0 | 0.9 | 0.9 | 0.9 | 0.9 | 0 | 0.9 |
| 130 XL | 0.15 | 0.15 | — | 0 | 0 | 0 | 0.15 | 0 |
| color master batch | 0 | 1 | 0.14 | 0.15 | 0.15 | 0.15 | 0 | 0.5 |
| | | (red) | (yellow) | (orange) | (blue) | (green) | | (black) |
| Core Data | | | | | | | | |
| size | 1.545" | 1.545" | 1.545" | 1.545" | 1.545" | 1.545" | 1.57" | 1.545" |
| weight | not measured | not measured | not measured | 36.7 | 38.7 | 38.5 | 36.1 | not measured |
| Rhiele Comp | — | — | — | 98 | 100 | 108 | 90 | — |
| PGA Comp | — | — | — | 64 | 60 | 52 | 70 | — |
| COR | — | — | — | .776 | .767 | .767 | .789 | — |

The cover of the golf ball in the present invention is based on a soft resin material comprising one or more resins selected form among ionomer resins, other thermoplastic resins, thermoset resins, polyurethane resins, polyester resins, polyamide elastomer resins, polyamide-ionomer copolymers and thermoplastic or thermoset metallocene catalyzed polyolefin resins. It is preferred that the cover of the ball comprise an ionomeric resin having 90–100 weight % of one or more ionic copolymers which are preferably acrylate-ester containing. The one or more acrylate ester-containing ionic copolymers are each formed from the reaction of: (a) an olefin having 2 to 8 carbon atoms; (b) an unsaturated monomer of the acrylate ester class having from 1 to 21 carbon atoms; and (c) an acid which includes at least one member selected from the group consisting of α, β-ethylenically unsaturated mono- or dicarboxylic acids with a portion of the acid groups being neutralized with cations.

To obtain golf ball covers of the present invention having a Shore D hardness in the upper part of the 20–57 or 20–54 range, either an ionic copolymer or an ionic terpolymer can be used in the cover. However, when it is beneficial to have a softer cover with a lower Shore D hardness rating, it may be necessary to use ionic terpolymers exclusively as the ionomer of the cover.

In each ionic copolymer and terpolymer of the invention, the olefin preferably is an alpha olefin, and the acid preferably is acrylic acid or methacrylic acid, Typically, the ionic copolymers and terpolymers have a degree of neutralization of the acid groups in the range of about 10–100%.

It is particularly preferred that the cover of the ball comprise an ionomeric resin wherein 95–100 weight % of the ionomeric resin is one or more acrylate ester-containing ionic copolymers. Each of the acrylate ester-containing copolymers preferably comprises ethylene, at least one acid selected from the group consisting of acrylic acid, maleic acid, fumaric acid, itaconic acid, methacrylic acid, and half-esters of maleic, fumaric and itaconic acids, and at least one comonomer selected from the group consisting of methyl, ethyl, n-propyl, n-butyl, n-octyl, 2-ethylhexyl, and 2-methoxyethyl-1 acrylates.

The one or more acrylate ester-containing ionic copolymers to be used in forming the cover of the golf ball of the invention each contain an olefin, an acrylate ester, and an acid. In a blend of two or more acrylate ester-containing ionic copolymers, each copolymer may contain the same or a different olefin, acrylate ester and acid than are contained in the other copolymers. Preferably, the acrylate ester-containing ionic copolymer or copolymers are terpolymers, but additional monomers can be combined into the copolymers if the monomers do not substantially reduce the scuff resistance or other good playability properties of the cover.

For a given copolymer, the olefin is selected from the group consisting of olefins having 2 to 8 carbon atoms, including, as non-limiting examples, ethylene, propylene, butene-1, hexene-1 and the like. Preferably the olefin is ethylene.

The acrylate ester is an unsaturated monomer having from 1 to 21 carbon atoms which serves as a softening comonomer, The acrylate ester preferably is methyl, ethyl, n-propyl, n-butyl, n-octyl, 2-ethylhexyl, or 2-methoxyethyl 1-acrylate, and most preferably is methyl acrylate or n-butyl acrylate. Another suitable type of softening comonomer is an alkyl vinyl ether selected from the group consisting of n-butyl, n-hexyl, 2-ethylhexyl, and 2-methoxyethyl vinyl ethers.

The acid is a mono- or dicarboxylic acid and preferably is selected from the group consisting of methacrylic, acrylic, ethacrylic, α-chloroacrylic, crotonic, maleic, fumaric, and itaconic acid, or the like, and half esters of maleic, fumaric and itaconic acid, or the like. The acid group of the copolymer is 10–100% neutralized with any suitable cation, for example, zinc, sodium, magnesium, lithium, potassium, calcium, manganese, nickel, chromium, tin, aluminum, or the like. It has been found that particularly good results are obtained when the neutralization level is about 20–80%.

The one or more acrylate ester-containing ionic copolymers each has an individual Shore D hardness which typically falls within the range of 5–64. The overall Shore D hardness of the acrylate ester-containing ionic copolymer or blend of acrylate ester-containing ionic copolymers is 57 or less in one embodiment and 54 or less in another embodiment in order to impart particularly good playability characteristics to the ball. It has been found that excellent results can be obtained when the Shore D hardness of the acrylate ester-containing ionic copolymer or acrylate ester-containing ionic copolymer blend is in the range of 54 or less for a softer covered golf ball or 57 or less for a somewhat harder ball.

The cover of the invention is formed over a core to produce a golf ball having a coefficient of restitution in the range of 0.730 or greater. More preferably, the ball has a coefficient of restitution in the range of 0.760 or more, and most preferably 0.770 or more. The coefficient of restitution of the ball will depend upon the properties of both the core and the cover.

The acrylate ester-containing ionic copolymer or copolymers used in the golf ball of the invention can be obtained by neutralizing commercially available acrylate ester-containing acid copolymers such as polyethylene-methyl acrylate-acrylic acid terpolymers. Such materials include ESCOR ATX commercially available from Exxon Chemical Co. or poly (ethylene-butyl-acrylate-methacrylic acid) terpolymers, including NUCREL commercially available from E. I. duPont de Nemours, Inc., Wilmington, Del. Particularly preferred commercially available materials include ESCOR ATX 320, ATX 325, ATX 310, ATX 350, and blends of these materials with NUCREL 010 and NUCREL 035. The acid groups of these materials and blends are neutralized with one or more of various cation salts obtained from the metals of groups I, II, IV-A and VIII-B of the Periodic Table. The salts of zinc, sodium, magnesium, lithium, potassium, calcium, manganese, and nickel are particularly preferred. The degree of neutralization ranges from 10–100%. Generally, a higher degree of neutralization results in a harder and tougher cover material. The properties of non-limiting examples of commercially available un-neutralized acid terpolymers which can be used to form the golf ball covers of the invention are provided below in Table II,

TABLE 11

| Material | Melt Index dg/min ASTM D1238 | Acid No. % KOH/g | Flex modulus MPA ASTM D790 | Shore D Hardness |
|---|---|---|---|---|
| ESCOR ATX 310 | 6 | 45 | 80 | 44 |
| ESCOR ATX 320 | 5 | 45 | 50 | 34 |
| ESCOR ATX 325 | 20 | 45 | 9 | 30 |
| ESCOR ATX 350 | 6 | 15 | 20 | 28 |
| NUCREL 010 | 11 | 60 | 40 | 40 |
| NUCREL 035 | 35 | 60 | 59 | 40 |

The ionomer resins used to form the golf balls of the invention are produced by reacting the acrylate ester-containing acid copolymer with various amounts of the metal cation salts at a temperature above the crystalline melting point of the copolymer, such as a temperature from about 200° F. to about 500° F., preferably from about 250° F. to about 350° F., under high shear mixing conditions and at a pressure of from about 100 psi to 10,000 psi. The amount of metal cation salt utilized to produce the neutralized ionic copolymers is a predetermined quantity which provides a sufficient amount of the metal cations to neutralize the desired percentage of the carboxylic acid groups in the high acid copolymer. However, the copolymers may also be blended after neutralization as long as the practitioner of the art recognizes that the polymers may be less well blended using this procedure.

The polyurethane suitable for use in the cover of the present invention includes thermoplastic and castable types of polyurethane. Specific examples of thermoplastic polyurethanes suitable for the present invention include Texin polyurethane materials commercially available from Miles, Inc., Pittsburgh, Pa., PELLATHANE polyurethanes from Dow Plastics, Midland, Mich., and ESTANE polyurethanes from B. F. Goodrich of Cleveland, Ohio. Castable polyurethanes include materials such as BAYDUR, commercially available from Miles Inc. and Airthanes polyurethanes from Air Products, Allentown, Pa.

The polyester elastomer for use in the cover of the present invention includes materials sold under the trademark HYTREL, commercially available from E. I. duPont de Nemours, Inc., Wilmington, Del. Suitable grades may include polyester elastomers such as HYTREL 3078 which has a Shore D hardness of 30; HYTREL 4556 having a Shore D hardness of 45, and HYTREL 5556 with a Shore D hardness of 55. A polyester amide such as that marketed by Elf Atochem S.A., France, under the trademark PEBAX is also suitable for use as a cover material in the present invention.

Appropriate fillers or additive materials may also be added to produce the cover compositions of the present invention. These additive materials include dyes (for example, ULTRAMARINE BLUE sold by Whitaker, Clark and Daniels of South Plainfield, N.J.), and pigments, i.e., white pigments such as titanium dioxide (for example UNITANE 0-110 commercially available from Keveira, Savannah, Ga.), zinc oxide, and zinc sulfate, as well as fluorescent pigments. As indicated in U.S. Pat. No. 4,884,814, the amount of pigment and/or dye used in conjunction with the polymeric cover composition depends on the particular base ionomer mixture utilized and the particular pigment and/or dye utilized. The concentration of the pigment in the polymeric cover composition can be from about 1% to about 10% as based on the weight of the base ionomer mixture. A more preferred range is from about 1% to about 5% as based on the weight of the base ionomer mixture. The most preferred range is from about 1% to about 3% as based on the weight of the base ionomer mixture. The most preferred pigment for use in accordance with this invention is titanium dioxide.

Moreover, since there are various hues of white, i.e., blue white, yellow white, etc., trace amounts of blue pigment may be added to the cover stock composition to impart a blue-white appearance thereto. However, if different hues of the color white are desired, different pigments can be added to the cover composition at the amounts necessary to produce the color desired.

In addition, it is within the purview of this invention to add to the cover compositions of this invention compatible material which do not affect the basic novel characteristics of the composition of this invention, Among such materials are antioxidants (i.e., SANTONOX R, commercially available from Flexays, Akron, Ohio), antistatic agents, stabilizers, compatabilizers and processing aids. The cover compositions of the present invention may also contain softening agents, such as plasticizers, etc., and reinforcing materials such as glass fibers and inorganic fillers, as long as the desired properties produced by the golf ball covers of the invention are not impaired.

Furthermore, optical brighteners, such as those disclosed in U.S. Pat. No. 4,679,795, may also be included in the cover composition of the invention. Examples of suitable optical brighteners which can be used in accordance with this invention are UVITEX OB as sold by the Ciba-Geigy Chemical Company, Ardsley, N.Y., UVITEX OB thought to be 2,5-Bis(5-tert-butyl-2-benzoxazoyl)-thiophens. Examples of other optical brighteners suitable for use in accordance with this invention are as follows: LEUCOPURE EGM as sold by Sandoz, East Hanover, N.J. LEUCOPURE EGM is thought to be 7-(2n-naphthol(1,2-d)-triazol-2yl)3phenyl-coumarin. PHORWHITE K-20G2 is sold by Mobay Chemical Corporation, Union Metro Park, Union, N.J. 07083, and is thought to be a pyrazoline derivative. EASTOBRITE OB-1 as sold by Eastman Chemical Products, Inc., Kingsport, Tenn., is thought to be 4,4-Bis(-benzoxaczoly) stilbene. The above-mentioned UVITEX and EASTOBRITE OB-1 are preferred optical brighteners for use in accordance with this invention.

Moreover, since many optical brighteners are colored, the percentage of optical brighteners utilized must not be excessive in order to prevent the optical brightener from functioning as a pigment or dye in its own right.

The percentage of optical brighteners which can be used in accordance with this invention is from about 0.01% to about 0.5% as based on the weight of the polymer used as a cover stock. A more preferred range is from about 0.05% to about 0.25% with the most preferred range from about 0.10% to about 0.20% depending on the optical properties of the particular optical brightener used and the polymeric environment in which it is a part.

Generally, the additives are admixed with an ionomer to be used in the cover composition to provide a masterbatch (abbreviated herein as MB) of desired concentration and an amount of the masterbatch sufficient to provide the desired amounts of additive is then admixed with the copolymer blends.

The metallocene catalyzed polyolefin for use in the present invention is a polymer produced using a single-site metallocene catalyst. Typically, a polymer produced using a metallocene catalyst has a narrow molecular weight distribution and a uniform molecular architecture. Polymers made in this way can be tailored to have unique properties that are suitable for a specific application.

Preferably, the metallocene polymer is polyethylene or a copolymer of ethylene with butene, hexene, octene, or norbornene. Pendant groups may also be added to metallocene polymers by post-polymerization reactions to modify physical or chemical properties of the polymer. Metallocene polymers useful with the golf balls of the invention include metallocene polymers of the formula:

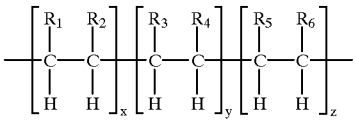

wherein $R_1$ is hydrogen; $R_2$ is one or more members of the group consisting of hydrogen or a lower alkyl group of 1–5 carbons; $R_3$ is one or more members of the group consisting of hydrogen and lower alkyl groups of 1–5 carbons; $R_4$ is one or more members of the group consisting of hydrogen and alkyl groups of 1–10 carbons, phenyl, phenyl with 1–5 hydrogens substituted with one or more members of the group consisting of COOH, $SO_3H$, $NH_2$, F, Cl, Br, I, OH, SH, silicone, lower alkyl esters and lower alkyl ethers with the proviso that $R_3$ and $R_4$ can be combined to form a bicyclic ring; $R_5$ is one or more members selected form the group consisting of hydrogen, lower alkyl groups of 1–5 carbons which may be carbocyclic, aromatic or heterocyclic; and x ranges from 99–50 wt. % of the polymer, y ranges from 1–50 wt. % of the polymer, and z ranges from 0–49 wt. % of the polymer. Specific examples of metallocene catalyzed polyolefins for use in the present invention include those materials sold under the trademark ENGAGE, commercially available front Dow Chemical Corporation, Midland, Mich., and EXACT, commercially available from Exxon Chemical Corporation, Houston, Tex.

The golf ball of the present invention is manufactured by molding the cover in place over a golf ball core. The cover may be formed by generally conventional means, such as by compression molding or by injection molding of the cover composition over the spherical core in order to produce a golf ball with a diameter of about 1.680 inches, and weighing about 1.620 ounces, The golf balls made for this comparative study were all of the single layer cover variety. However, the invention contemplates the possibility of a multilayer cover being formed with the composition of the present invention. Molding a cover in multiple layers is commonly done to accommodate covers having thicknesses greater than about 3.0 mm to accommodate processing conditions and uniformity of the molded covers. This is especially true when the covers are injection-molded. In compression molding, it may be appropriate to mold a thicker cover in a single layer.

In compression molding, the cover composition is first formed by an injection at about 380° F.–450° F. into smooth surfaced hemispherical shells. The shells are positioned around the core in an appropriately dimpled golf ball mold and are then subjected to compression molding at 200–300° F. for 2–10 minutes followed by cooling at 50–70° F. for 2–10 minutes, in order to fuse the materials together to form a unitized bell.

When injection-molded, the cover composition is injected directly around the core placed in the center of a golf ball mold for a period of time at a mold temperature of from 50–100° F.

Subsequent to molding, the golf balls may optionally undergo various finishing steps, such as flash trimming, priming, marking, finish coating, and the like as is well known and disclosed, for example in U.S. Pat. No. 4,911,451.

Several batches of cover material were also prepared by mixing the resin components with quantities of top grade master batch pigment/filler bland. The specific formulations of the cover materials are as set forth in Table IV below:

TABLE IV

| | Cover Types | | | | | |
|---|---|---|---|---|---|---|
| Ingredients | 1 pph | 2 pph | 3 pph | 4 pph | 5 pph | 6 pph |
| IOTEK 8000 | 19 | 14.7 | 10.2 | 33 | 23.5 | — |
| IOTEK 7030 | 26.3 | 22.0 | 17.5 | 7.22 | 7.22 | 7.22 |
| IOTEK 7510 | — | — | — | 57.5 | 67 | 90.5 |
| IOTEK 7520 | 52.4 | 61 | 70 | — | — | — |
| TG MB* | 2.3 | 2.3 | 2.3 | 2.28 | 2.28 | 2.28 |

*TG MB = top grade master batch; a mix of additives including coloring materials and fillers added to the cover composition to achieve the desired color, weight and other characteristics of the finished product.

From the various cores and cover material formulations complete golf balls were made for comparative testing. The golf balls were made by centering the core in a golf ball mold and injection molding the cover in place around the core.

The balls thus made were measured for size and weighed and were then tested for Shore D hardness, compression and COR.

Another preferred form of the invention is a method of making a golf ball. The method comprises the steps of obtaining a soft golf ball core and forming a soft cover over the core. The cover comprises an ionomeric resin having more than 90 weight % of one of more acrylate ester-containing ionic copolymers formed from (a) an olefin having 2 to 8 carbon atoms, (b) an unsaturated monomer of the acrylate ester class having from 1 to 21 carbon atoms, and (c) an acid which is selected from the group consisting of alpha, beta-ethylenically unsaturated mono- or dicarboxylic acids with a portion of the acid groups being neutralized with cations.

The combination of the cores of Table I and the covers of Table IV as well as the test data from these combinations are set forth in Table V below:

TABLE V

| Example No. | Core Type | Cover Type | Size | Weight | PGA Comp | Riehle Comp | COR | Estimated Shore D |
|---|---|---|---|---|---|---|---|---|
| 1/1 | A | 1 | 1.68 | 45.1 | 60 | 100 | .794 | 57 |
| 1/2 | A | 2 | 1.68 | 45.1 | 57 | 103 | .791 | 54 |
| 1/3 | A | 3 | 1.68 | 45.1 | 59 | 101 | .794 | 50–51 |
| 3/1 | C | 4 | 1.68 | 45.5 | 81 | 79 | .791 | 56–57 |
| 3/2 | D | 4 | 1.68 | 45.4 | 74 | 86 | .786 | 56–57 |
| 3/3 | E | 4 | 1.68 | 45.4 | 67 | 93 | .784 | 56–57 |
| 3/4 | F | 4 | 1.68 | 45.4 | 60 | 100 | .777 | 56–57 |
| 4/1 | G | 4 | 1.71 | 45 | 71 | 89 | .793 | 56/57 |
| 4/2 | G | 4 | 1.71 | 45 | 71 | 89 | .793 | 56/57 |
| 4/3 | G | 4 | 1.71 | 45 | 71 | 89 | .793 | 56/57 |
| 4/4 | G | 5 | 1.71 | 45 | 68 | 92 | .789 | 52 |
| 4/5 | G | 5 | 1.71 | 45 | 57 | 93 | .789 | 52 |
| 4/6 | G | 5 | 1.71 | 45 | 59 | 91 | .789 | 52 |
| 5/1 | H | 4 | 1.68 | 45.2 | 64 | 96 | .784 | 56–57 |
| 5/2 | H | 6 | 1.68 | 45.5 | 57 | 103 | .773 | 46 |
| 5/3 | C | 4 | 1.68 | 45.5 | 85 | 75 | .775 | 56–57 |

Example Number = first number denotes series; second number denotes sample. Examples 4/1, 4/2 and 4/3 are the same construction except for dimple patterns. Likewise, examples 4/4, 4/5 and 4/6 feature the same construction but have different dimple patterns.

The term "mechanical impedance" is defined as the ratio of an external force applied to a point of a body over the response speed of another point of the same body when the force is applied. Such mechanical impedance is used in analyzing vibrational characteristics of structures such as aircraft, buildings, bridges, and so on.

More simply defined, mechanical impedance is a parameter which represents the tendency of a body (structure) to resist mechanical vibration imposed by a source external to the body. Thus, a body having a relatively low mechanical impedance is more easily influenced by mechanical vibration or energy applied thereto than a body having a relatively high mechanical impedance.

The mechanical impedance of a body varies depending on the frequency of mechanical vibration imposed on the body. Each of the frequencies at which the mechanical impedance of the body shows a corresponding local minimum value is called the "natural frequency" or "natural resonance" of the body. It will be appreciated that at a "minimum value" of mechanical impedance the resistance to the vibration imposed on the body will be low and consequently transmission of the vibration will be high. In other words, at these minimum impedance frequencies the body is more likely to vibrate.

If the frequency of a vibrational source coincides with the natural frequency of a body or a harmonic derivative thereof, the body will vibrate more readily because of vibrational resonance. In other words, the vibrational resonance will cause the energy of the vibrational source to be transmitted to the body, thereby getting the body in motion. The effect of such vibrational resonance will become most pronounced when the frequency of the vibrational source is the primary or lowest natural frequency of the body.

In structures, as exemplified by various anecdotes regarding vehicles, buildings, bridges, and machines, vibrational resonance can cause vigorous vibration and, if permitted, may reach such a state of uncontrollable motion that failure of the structure can result. A classic example of structural failure caused by vibrational resonance is that of the destruction by wind of the Tacoma Narrows Bridge over Puget Sound, aptly nicknamed "Galloping Gertie".

Consequently, it is an established engineering practice to design structures with a view to avoiding vibrational resonance with any possible sources of vibration. However, it is envisioned by the inventors that natural frequency may also be used to great advantage in designing such things as sporting goods equipment. For example, it is believed that certain synergistic play results may be obtained by matching the natural frequency of a ball with the natural frequency of the club face with which the ball is struck. Matching natural frequency allows for the most efficient transfer of energy to the ball, and thus increasing the potential for higher quality play.

The natural frequency and mechanical impedance of the golf balls of this invention and some commercially available golf balls was determined through laboratory testing. The determination was carried out through the measurement of acceleration response over a sine-sweep of frequencies. In the testing, the subject golf ball was bonded to a vibrator using LOCTITE 409 adhesive. Likewise, a first accelerometer (Model A353B17, commercially available from PCB Piezotronics, Inc., New York) was also bonded to the golf ball, The vibrator was activated and caused to vibrate in a "sine-sweep" of frequencies ranging from 10–10,000 Hz. A second accelerometer was attached directly to the vibrator and together with the first accelerometer fed data to a dynamic signal analyzer (Model 35670A, commercially available from Hewlett Packard Co., Palo Alto, Calif.

The signal analyzer was able to calculate the mechanical impedance of the golf ball and plot this measurement over the range of frequencies being analyzed. The natural resonant frequency of the golf ball was determined by observing the frequency at which a second minimum occurred in the impedance curve determined by the frequency analyzer. The first minimum value is the result of forced node resonance resulting from contact with the accelerometer or the vibrator. This determination concerning the first minimum was made by comparing data obtained by testing other golf balls using an impact test method to determine natural frequency. In the impact method, the golf ball is suspended via a string and the ball is struck with a hammer on one side of the ball, while accelerometer measurements were taken on the opposite side of the ball.

the test ball. As the lower anvil is raised by the crank and the gap is closed, the apparatus applies compressive force and presses the ball against the spring loaded upper anvil. When the equilibrium point of the spring is reached the deflection of the upper anvil is measured with a micrometer. When testing a ball where deflection of the upper anvil is less than 0.100 inches the ball will be regarded as having a PGA compression of "0". In practice, tournament quality balls have compression ratings around 80–100 which means that the upper anvil was deflected a total of 0.100–0.120 inches.

TABLE VI

| Sample Number | Core Type | Cover Type | Thickness | Shore C/D | Size | Weight | Riehle Comp | PGA Comp | COR | Natural Frequency |
|---|---|---|---|---|---|---|---|---|---|---|
| 48A | #1 | A | 0.070" | 83/57 | 1.580" | 45.4 g | 84 | 76 | 789 | 2674 |
| 48B | #2 | A | 0.070" | 83/57 | 1.681" | 45.6 g | 59 | 101 | 773 | 3468 |
| 48C | #3 | A | 0.060" | 83/57 | 1.682" | 45.8 g | 99 | 61 | 775 | 2377 |
| 48D | #2 | B | 0.070" | 66/41 | 1.681" | 45.6 g | 88 | 72 | 777 | 2476 |
| 48 | #2 | 8 | 0.070" | 66/41 | 1.583" | 45.9 g | 53 | 97 | 764 | 2748 |
| 48F | #3 | B | 0.060" | 66/41 | 1.684" | 45.9 g | 107 | 53 | 764 | 2154 |
| 53G | #1 | C | 0.070" | 92/64 | 1.680" | 45.4 g | 77 | 83 | 803 | 3070 |
| 53H | #2 | C | 0.070" | 92/64 | 1.683" | 45.8 g | 55 | 105 | 791 | 3466 |
| 53I | #3 | C | 0.060" | 92/64 | 1.684" | 45.9 g | 96 | 64 | 792 | 2674 |

| Materials | Cover A | Cover B | Cover C | | Core #1 | Core #2 | Core #3 |
|---|---|---|---|---|---|---|---|
| OTEK 8000 | 21.5% | — | 23% | size | 1.545" | 1.545" | 1.560" |
| IOTEK 7520 | 47.6% | 90.6% | 33.8% | weight | 36.7 g | 37.0 g | 37.8 g |
| IOTEK 7030 | 21.5% | — | 33.8% | Rhiele Comp | 85 | 56 | 105 |
| white mb | 94% | 9.4% | 9.4% | PGA Comp | 75 | 104 | 55 |
| | | | | COR | 785 | 774 | 768 |

The balls of the present invention have a mechanical impedance with a primary minimum value in the frequency of 2400 Hz or less. Preferably, the frequency of the primary minimum value is in the range of 1800–2400 Hz. Most preferably, the frequency of the primary minimum value is in the range of 2000–2400 Hz.

When subjected to tests for mechanical properties such as PGA compressibility and Shore D hardness to determine cover hardness, it is readily apparent that some balls are relatively soft compared to others. The property of compression is typically measured or reported as "PGA compression" and is a scaled rating of the relative compressibility of a golf ball on a scale of from 0 to 200 wherein a lower compression rating number, the softer the golf ball. For instance, a ball with a PGA compression rating of 50 is softer than a ball with a PGA compression rating of 100. In practice, a preferred tournament quality ball will typically have a compression rating in the range of from 80–100.

To determine the PGA compression a standard compressive force is applied to the to the ball. A ball which exhibits no deflection (0.0 inches in deflection) under this force is rated 200, while a ball which deflects a test maximum of 0.200 inches is rated 0. Every incremental change of 0.001 inches in deformation represents a one point drop in the PGA compression rating of the ball. Consequently, a ball which deflects 0.1 inches (100×0.001 inches) has a PGA compression rating of 100 (i.e., 200–100) and a ball which deflects 0.110 inches (110×0.001 inches) has a PGA compression rating of 90 (i.e., 200–110).

To determine PGA compression a golf ball is placed in an apparatus which has the form of a small press with an upper and lower anvil. The upper anvil is at rest against a 200 pound spring die, and the lower anvil has a range of linear travel of about 0.300 inches by means of a crank mechanism. In its open position, the gap between the anvils is sufficient to allow a clearance of at least 0.100 inches for insertion of Other devices are known in the industry for determining golf ball compression, including the modified Riehle Compression Machine. The Riehle apparatus was originally produced by Riehle Brothers Testing Machine Company, Philadelphia, Pa. and was adapted for use in testing compression of golf balls by determining the deformation of the ball under a fixed initialized load of 200 pounds. Using such a device, a Riehle compression number of 61 corresponds to a deflection under load of 0.061 inches. Consequently, there is a relationship between PGA compression and Riehle compression for golf balls of approximately the same size. It has been determined by the applicant that Riehle compression corresponds to PGA compression according to the general formula:

$$PGA\ \text{compression} = 160 - \text{Riehle compression}$$

Consequently, a Riehle compression of 80 corresponds to a PGA compression of 80, a Riehle compression of 70 corresponds to a PGA compression of 90 and a Riehle compression of 60 corresponds to a PGA compression of 100. For the purposes of reporting test data in this application, the applicant's compression values all were initially measured as Riehle compression and then converted to PGA compression for reporting throughout this application.

Shore D hardness measurements are commonly used to determine the cover hardness of a golf ball, As used herein, the term "Shore D hardness" is a measurement of a golf ball cover taken generally in accordance with ASTM D-2240, with the exception that all measurements are made at on the curved surface of the cover of a ball, rather than on a flat sample of cover material in the form of a flat plaque. In these measurements the golf ball is completely intact, with the cover in place surrounding the core. To make the measurement of Shore D hardness as uniform as possible the measurements are taken at "land" areas of the golf ball cover, i.e., on portions of the cover between the dimples.

The compression of the ball can affect the playability of the ball on striking and also the sound or "click" produced upon striking. Similarly, compression can affect the "feel" of the ball (i.e., a soft, responsive feel), particularly in chipping and putting. While compression itself has little bearing on the flight distance performance of a golf ball, compression can affect the playability of the ball upon striking. The degree of compression of a ball against the club face and the softness of the cover strongly influence the resultant spin rate which can be achieved with a given ball. Typically, a softer cover will produce a higher spin rate than a harder cover. Additionally, a harder core will produce a higher spin rate than a softer core. This is because upon impact, a hard core serves to compress the cover of the ball against the face of the club to a much greater degree than does a soft core, thereby resulting in more "grab" of the ball on the club face and subsequent higher spin rate. In effect, the cover is squeezed between the relatively hard golf ball core and club head. When a softer core is used, the cover is under much less compressive stress than when a harder core is used and therefore does not contact the club face as intimately. This results in lower spin rates. Ball softness is generally predictive, though not absolutely determinative, of the ball's spin rate potential.

The resilience or coefficient of restitution of a golf ball is designated as the constant "e", which is the ratio of the relative velocity of an elastic sphere after direct impact to that before impact. As a result, the COR ("e") can vary from 0 to 1, with 1 being equivalent to a perfect or completely elastic collision and 0 being equivalent to a perfectly or completely inelastic collision.

COR, along with additional factors such as club head speed, club head mass, ball weight, ball size and density, spin rate, angle of trajectory and surface configuration (i.e., dimple pattern and area of dimple coverage) as well as environmental conditions (e.g. temperature, moisture, atmospheric pressure, wind, etc.) generally determine the distance a ball will travel when hit.

The COR in solid core balls is a function of the composition of the molded core and of the cover. The molded core and/or cover may be comprised of one or more layers such as in multi-layered balls. In balls containing a wound core (i.e., balls comprising a liquid or solid center, elastic windings, and a cover), the coefficient of restitution is a function of not only the composition of the center and cover, but also the composition and tension of the elastomeric windings. As in the solid core balls, the center and cover of a wound core ball may also consist of one or more layers.

In the examples of this application, the coefficient of restitution was measured by propelling a ball horizontally at a speed of 125±5 feet per second (fps) and corrected to 125 fps against a generally vertical, hard, flat steel plate and measuring the ball's incoming and outgoing velocity electronically. Speeds were measured with a pair of Oehler Mark 55 ballistic screens available from Oehler Research, Inc. P.O. Box 9135, Austin, Tex. 78766, which provide a timing pulse when an object passes through them. The screens were separated by 36" and are located 25.25" and 61.25" from the rebound wall, The ball speed was measured by timing the pulses from screen 1 to screen 2 on the way into the rebound wall (as the average speed of the ball over 36"), and then the exit speed was timed from screen 2 to screen 1 over the same distance. The rebound wall was tilted 2 degrees, from a vertical plane to allow the ball to rebound slightly downward in order to miss the edge of the cannon that fired it. The rebound wall is solid steel 2.0 inches thick.

As indicated above, the incoming speed should be 125±5 fps but corrected to 125 fps. the correlation between COR and forward or incoming speed has been studied and a correction has been made over the ±5 fps range so that the COR is reported as if the ball had an incoming speed of exactly 125.0 fps.

The coefficient of restitution must be carefully controlled in all commercial golf balls if the ball is to be within the ball performance standards established by the USGA. The USGA standards specify that a "regulation" ball cannot have an initial velocity exceeding 255 feet per second in an atmosphere of 75° F. when tested on a USGA machine. Since the coefficient of restitution of a ball is related to the ball's initial velocity, it is highly desirable to produce a ball having sufficiently high coefficient of restitution to closely approach the USGA limit on initial velocity, while having an ample degree of softness (i.e., hardness) to produce enhanced playability (i.e., spin, etc.).

As will be apparent to persons skilled in the art, various modifications and adaptations of the invention will become readily apparent without departure from the spirit and scope of the invention.

What is claimed is:

1. A two-piece golf ball, comprising:

a solid core and a cover layer comprising polyurethane and having a Shore D hardness of 57 or less, the ball having a PGA compression of 62 or less and a coefficient of restitution of at least 0.730.

2. A golf ball according to claim 1, wherein the cover layer has a Shore D hardness of 20–54.

3. A golf ball as claimed in claim 2, wherein said ball has a mechanical impedance with a primary minimum value in the frequency range of 1,800–2,400 Hz.

4. A golf ball according to claim 1, wherein the cover layer has a Shore D hardness of 20–50.

5. A golf ball according to claim 1, wherein the ball has a PGA compression of about 60 or less.

6. A golf ball as claimed in claim 1, wherein said ball has a coefficient of restitution of at least 0.730.

7. A golf ball as claimed in claim 1, wherein said ball has a mechanical impedance with a primary minimum value in the frequency range of 2,400 or less Hz when said ball is maintained under conditions of about 21° C., 1 atmosphere of pressure and 50% relative humidity for 15 or more hours immediately prior to frequency testing.

8. A golf ball as claimed in claim 1, wherein the cover layer has a Shore D hardness in the range of 20–57 and said ball has a PGA compression in the range of 10–62.

9. A golf ball as claimed in claim 1, wherein the cover layer has a Shore D hardness in the range of 40–57 and said ball has a PGA compression in the range of 20–62.

10. A golf ball as claimed in claim 1, wherein the cover layer has a Shore D hardness in the range of 45–54 and said ball has a PGA compression in the range of 30–60.

11. A golf ball according to claim 1, wherein the polyurethane is a thermoplastic or a thermoset.

12. A golf ball comprising a solid core and a single cover layer comprising polyurethane and having a Shore D hardness of 54 or less, the ball having a PGA compression of 67 or less and a coefficient of restitution of at least 0.730.

13. A golf ball according to claim 12, wherein the cover layer has a Shore D hardness of 20–54.

14. A golf ball as claimed in claim 13, wherein said ball has a mechanical impedance with a primary minimum value in the frequency range of 1,800–2,400 Hz.

15. A golf ball according to claim 12, wherein the outer cover layer has a Shore D hardness of 40–54.

16. A golf ball as claimed in claim 12, wherein said ball has a mechanical impedance with a primary minimum value in the frequency range of 2,400 or less Hz when said ball is maintained under conditions of about 21° C., 1 atmosphere of pressure and 50% relative humidity for 15 or more hours immediately prior to frequency testing.

17. A golf ball as claimed in claim 12, wherein said cover layer comprises a thermoplastic polyurethane.

18. A golf ball as claimed in claim 12, wherein said single cover layer a Shore D hardness in the range of 20–54 and said ball has a PGA compression in the range of 10–67.

19. A golf ball as claimed in claim 12, wherein said single cover layer a Shore D hardness in the range of 40–54 and said ball has a PGA compression in the range of 20–67.

20. A golf ball according to claim 12, wherein the polyurethane is a thermoplastic or a thermoset.

21. A golf ball of two-piece construction comprising a solid core and a cover layer comprising polyurethane and having a Shore D hardness of 57 or less, the ball having a mechanical impedance with a primary minimum value in the frequency range of 2400 Hz or less when said ball is maintained under conditions of about 21° C., 1 atmosphere of pressure and 50% relative humidity for 15 or more hours immediately prior to frequency testing.

22. A golf ball as claimed in claim 21, wherein said primary minimum value is in the range of 1800–2400 Hz.

23. A golf ball as claimed in claim 21, wherein said primary minimum value is in the range of 2000–2400 Hz.

24. A two-piece golf ball comprising a solid core and a cover layer comprising metallocene catalyzed polyolefin and having a Shore D hardness of 57 or less, the ball having a PGA compression of 62 or less and a coefficient of restitution of at least 0.730.

25. A golf ball as claimed in claim 24, wherein said ball has a mechanical impedance with a primary minimum value in the frequency range of 2,400 or less Hz when said ball is maintained under conditions of about 21° C., 1 atmosphere of pressure and 50% relative humidity for 15 or more hours immediately prior to frequency testing.

26. A golf ball comprising a solid core and a single cover layer, said cover layer comprising a metallocene catalyzed polyolefin and having a Shore D hardness of 54 or less, the ball having a PGA compression of 67 or less and a coefficient of restitution of at least 0.730.

27. A golf ball as claimed in claim 26, wherein said ball has a mechanical impedance with a primary minimum value in the frequency range of 2,400 or less Hz when said ball is maintained under conditions of about 21° C., 1 atmosphere of pressure and 50% relative humidity for 15 or more hours immediately prior to frequency testing.

* * * * *